US008807904B2

(12) United States Patent
Peleman

(10) Patent No.: US 8,807,904 B2
(45) Date of Patent: Aug. 19, 2014

(54) METHOD FOR BINDING A BUNDLE OF LOOSE LEAVES OR THE LIKE AND END LEAF APPLIED THEREBY

(75) Inventor: Guido Peleman, Antwerp (BE)

(73) Assignee: Unibind Limited, Nicosia (CY)

( * ) Notice: Subject to any disclaimer, the term of this patent is extended or adjusted under 35 U.S.C. 154(b) by 294 days.

(21) Appl. No.: 13/298,681

(22) Filed: Nov. 17, 2011

(65) Prior Publication Data

US 2012/0063868 A1 Mar. 15, 2012

Related U.S. Application Data

(62) Division of application No. 11/992,775, filed as application No. PCT/IB2006/002737 on Oct. 2, 2006, now abandoned.

(30) Foreign Application Priority Data

| | | |
|---|---|---|
| Oct. 3, 2005 | (BE) | 2005/0477 |
| Oct. 6, 2005 | (BE) | 2005/0489 |
| Oct. 17, 2005 | (BE) | 2005/0508 |
| Apr. 6, 2006 | (BE) | 2006/0216 |

(51) Int. Cl.
*B42D 1/02* (2006.01)
*B42B 4/00* (2006.01)

(52) U.S. Cl.
USPC ..... 412/28; 412/8; 281/21.1; 281/24; 281/35

(58) Field of Classification Search
CPC ..... B42D 1/02; B42D 3/002; B42C 11/45; B42B 4/00
USPC ..... 281/21.1, 27, 27.3, 24, 35; 412/28, 8
See application file for complete search history.

(56) References Cited

U.S. PATENT DOCUMENTS

| | | | | |
|---|---|---|---|---|
| 2,005,680 | A * | 6/1935 | Miles et al. | 281/19.1 |
| 3,347,565 | A | 10/1967 | Konkel | |
| 3,437,506 | A | 4/1969 | Falberg | |
| 3,749,422 | A | 7/1973 | Abildgaard et al. | |
| 4,007,950 | A | 2/1977 | Giulie | |
| 4,498,828 | A | 2/1985 | Ackerman | |
| 2006/0198719 | A1 * | 9/2006 | Parker et al. | 412/4 |
| 2007/0216153 | A1 * | 9/2007 | Parker et al. | 281/21.1 |

FOREIGN PATENT DOCUMENTS

| | | |
|---|---|---|
| FR | 1 304 983 | 9/1962 |
| WO | 97/21551 A | 6/1997 |

* cited by examiner

*Primary Examiner* — Kyle Grabowski
(74) *Attorney, Agent, or Firm* — Bacon & Thomas, PLLC

(57) ABSTRACT

Method for binding a bundle of loose leaves or the like in a cover. The method includes the step of providing an end leaf that includes a fixing strip on a side edge, with the fixing strip partly fixed to the end leaf and provided with a strip of glue on a part of the fixing strip which is not fixed to the end leaf. On the side of the fixing strip turned away from the end leaf, said strip of glue being provided with a removable foil. Another step is binding a free edge of the bundle of loose leaves together with the end leaf. Further steps include removing the foil, and providing the bound edge of the bundle of leaves and the end leaf in the back of the cover and fixing thereof in the cover only by the strip of glue.

12 Claims, 6 Drawing Sheets

METHOD FOR BINDING A BUNDLE OF LOOSE LEAVES OR THE LIKE AND END LEAF APPLIED THEREBY

CROSS REFERENCE TO RELATED APPLICATIONS

This application is a divisional application of U.S. application Ser. No. 11/992,775, filed Mar. 28, 2008, which is the national stage of international application no. PCT/IB2006/002737, filed Oct. 2, 2006, and which further claims priority to Belgian application nos. BE 2005/0477 filed Oct. 3, 2005; BE 2005/0489, filed Oct. 6, 2005; BE2005/0508 filed Oct. 17, 2005; and BE 2006/0216, filed Apr. 6, 2006, the entire contents of all of which are incorporated herein by reference.

FIELD OF THE INVENTION

The present invention concerns a method for binding a bundle of loose leaves or the like.

In particular, the present invention concerns a method for binding a bundle of loose leaves or the like in a cover with a back.

BACKGROUND

A method for binding a bundle of loose leaves in a cover with a back is already known, whereby the end leaves of this bundle are provided on the respective outsides and are provided with a layer of glue over their entire surface, and whereby the leaves of this bundle are subsequently joined together on one side edge by means of gluing or stitching, after which this bundle of leaves is provided with the glued or stitched edge in the back of the cover and the cover is subsequently folded up, so that the end leaves are glued to the inside of the cover by the above-mentioned layer of glue.

A disadvantage of such a known method is that, in order to join the bundle of loose leaves together by means of gluing or stitching and to provide a layer of glue on the inside of the cover, a manufacturing device is always required which is usually relatively expensive, as a result of which such a method is not interesting for sporadic and/or private use.

SUMMARY

The present invention aims to remedy the above-mentioned and other disadvantages.

To this end, the present invention concerns a method for binding a bundle of loose leaves or the like in a cover with a back and leaves joined to the back, comprising the following steps:

- providing an end leaf that is provided with a fixing strip on a side edge, said fixing strip being partly fixed to the end leaf and being provided with a strip of glue on a part of the fixing strip which is not fixed to the end leaf and on the side of the fixing strip turned away from the end leaf, said strip of glue being provided with a removable foil;
- binding a free edge of the above-mentioned bundle of loose leaves together with the end leaf;
- removing the foil; and
- providing the bundle of leaves with its bound edge and end leaf in the back of the cover and fixing this bundle with end leaf in the cover only by means of the above-mentioned strip of glue.

The free edge of the bundle of loose leaves can be bound in many ways, for example by means of stapling, stitching, cold gluing, punching with plastic or metal rings or other binding techniques.

The bundle of leaves is preferably fixed in the cover by applying a strip of glue which has preferably been provided beforehand on the fixing strip of the end leaf which is bound together with the bundle of loose leaves.

Such a method is advantageous in that a bundle of loose leaves can be joined in a very simple and fast manner, for example by means of stapling, and in that this bundle can then be fixed in a cover without having to make use of expensive manufacturing devices.

The invention also concerns an end leaf for binding a bundle of loose leaves bound together with a side edge of said end leaf in a cover, whereby the end leaf is provided with a fixing strip on its side edge to be bound in the cover, said fixing strip being partly fixed to the end leaf and being provided with a strip of glue on a part of the fixing strip which is not fixed to the end leaf and on the side of the fixing strip turned away from the end leaf, said strip of glue being provided with a removable foil that has to be removed for fixing the fixing strip of the end leaf together with the bundle of leaves in the cover by means of said strip of glue only.

The document also reveals a binding element which can be applied in a method according to the invention, whereby this binding element consists of a binding element which has been folded or can be folded in a U- or V-shape, which is provided with at least one strip of glue on its outside and which is designed to be provided round the free edge of the bundle of leaves to be bound before the latter is provided in the cover.

BRIEF DESCRIPTION OF THE DRAWINGS

In order to better explain the characteristics of the invention, the following preferred method according to the invention for binding a bundle of loose leaves or the like is described, as well as an end leaf applied thereby, with reference to the accompanying drawings, in which.

DETAILED DESCRIPTION

Figure 1:
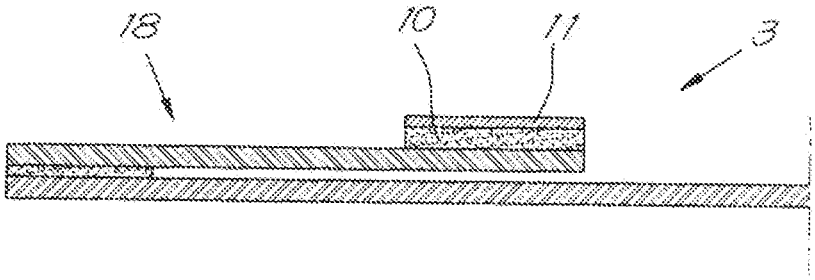
FIG. 1 represents an end leaf according to the invention.

FIG. 1 represents an end leaf 3 according to the invention whereby this end leaf 3 is provided with a fixing strip 18 on one side edge, for example made of paper, which fixing strip 18 is fixed to said edge of the end leaf 3 by means of gluing in this case.

According to the invention, only the side edge of the fixing strip 18 to be bound is hereby fixed to the end leaf 3.

On the part of the fixing strip 18 which is not glued to the end leaf 3, on the side turned away from the end leaf 3, is provided a strip of glue 10 at a distance from the above-mentioned side edge of the end leaf 3.

The end leaf 3 is made of a relatively rigid, either or not flexible material which can be stapled, such as for example cardboard, plastic or paper. These materials may be single-layered, multilayered, coated or laminated.

On the above-mentioned strip of glue 10 is provided a removable foil 11.

Figure 2:
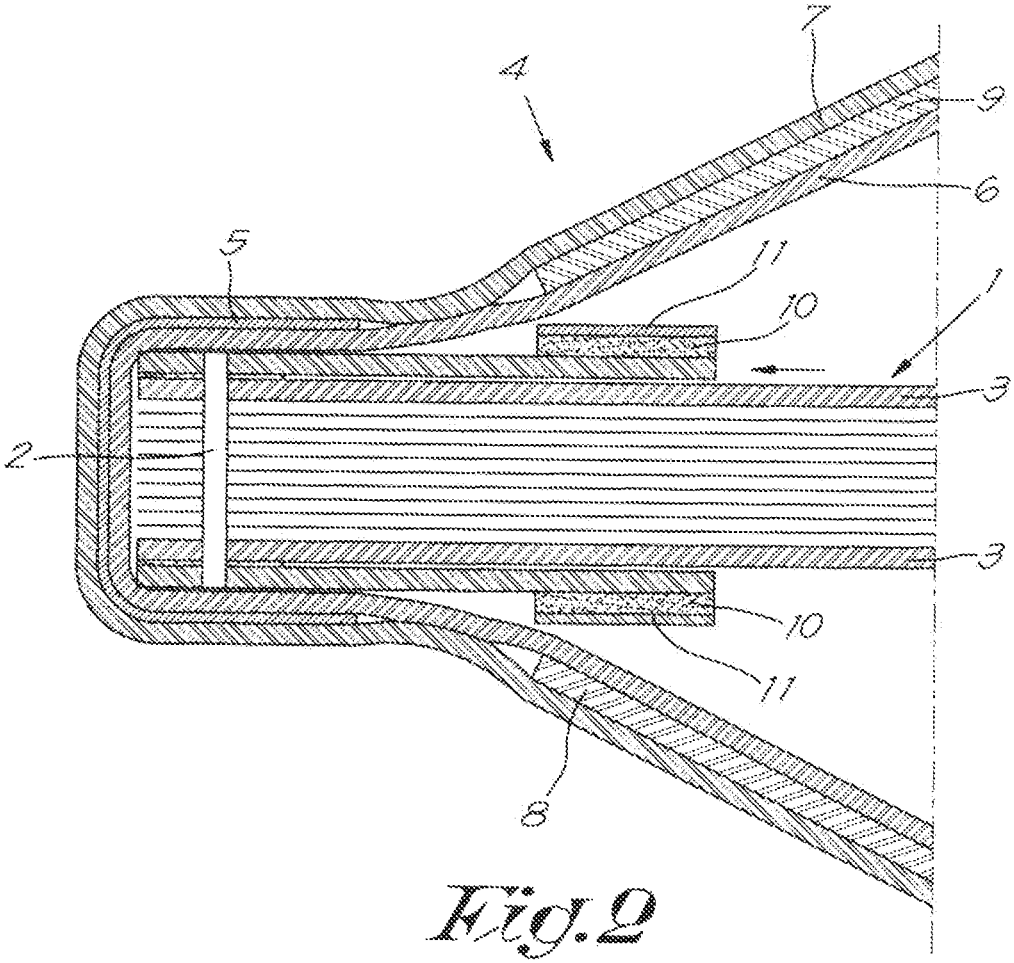
FIGS. 2 and 3 represent a method according to the invention.
Figure 3:
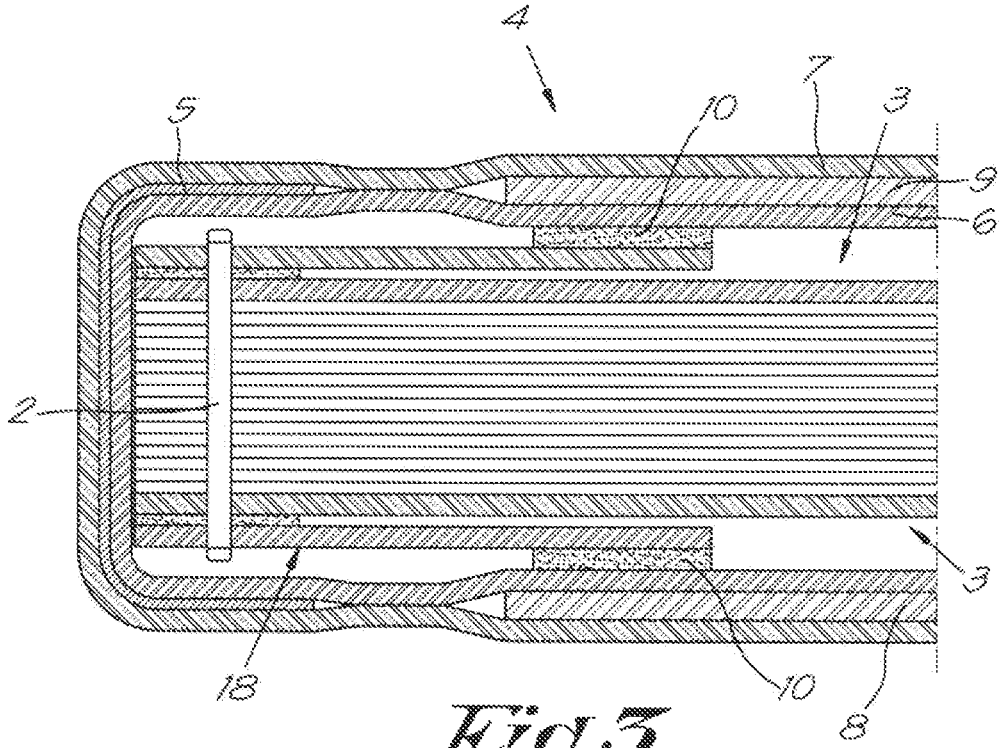

As is represented in FIGS. 2 and 3, in a method according to the invention, a free edge of a bundle of loose leaves 1 is first bound together with the end leaf according to FIG. 1, for example by using one or several staples 2.

It goes without saying that the present invention is not restricted to binding by means of stapling, but that also other binding techniques can be applied such as stitching, cold gluing, hot gluing, punching with plastic or metal rings or the like.

Each time we hereafter talk about stapling, also other binding techniques can be applied.

In this case, on either side of the bundle of leaves 1 to be bound, is provided an end leaf 3.

The end leaves 3 are hereby positioned such that their above-mentioned fixing strip 18 is situated on the side edge of the bundle of leaves 1 to be bound, and such that these fixing strips 18 are turned outward, away from the bundle of leaves 1.

The bundle of leaves 1 is preferably joined together with the end leaves 3 by providing staples 2 through the parts of the fixing strips 18 that are glued to the end leaves 3.

After the bundle of leaves 1 and the end leaves 3 have been bound together, the foils 11 are removed from the strips of glue 10 and the stapled bundle is provided with its stapled edge in a cover 4 and glued to the inside of the cover 4 by means of said fixing strips 18.

The latter is realized by folding up the cover 4, after the above-mentioned foils 11 have been removed, such that the bundle 1 is glued onto the inside of the cover 4 by the strips of glue 10.

In this case, the cover 4 is built as a U-shaped back 5 which is preferably made of metal, but which can also be made of any other, preferably hard material, such as for example ceramics, a rigid plastic, or the like.

It is clear that the above-mentioned back 5 of the cover 4 can also be made of any flexible material whatsoever and that this back 5 must not necessarily be U-shaped either.

Against the inside and outside of this back 5 is in this case provided a coating 6, 7 respectively.

The cover 4 is also provided with two preferably rigid leaves 8 and 9 which are joined in a folding manner to the above-mentioned back 5 on either side as they extend between the above-mentioned coatings 6 and 7 as well.

According to the invention, the above-mentioned leaves 8 and 9 can be made of plastic or in the shape of an either or not coated piece of cardboard or paper. These materials can be single-layered, multi-layered, coated or laminated.

It is clear that in a method according to the invention, many types of covers can be applied, and that, consequently, the present invention is not limited to the use of a cover 4 of the type represented in FIGS. 2 and 3.

As the part of the fixing strip 18 on which the above-mentioned strip of glue is provided is not fixed directly to the end leaf 3, the end leaves 3, when the cover 4 is opened, are not opened as well.

The latter yield the advantage that the bundle of leaves always opens nicely and that the presence of the staples 2 is not visible, as the end leaves 3 are not glued to the cover 4.

Another advantage of such an end leaf 3 is that, between the cover 4 and the end leaf 3, the strip of glue 10 is not visible as the end leaf's 3 own weight will not place a load on the strip of glue 10 when opening the cover 4.

Figure 4:
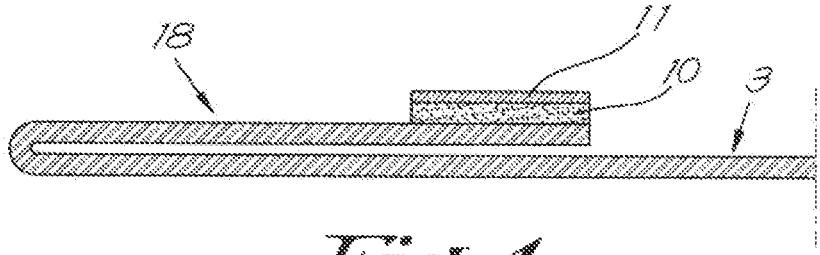
FIG. 4 represents a variant of an end leaf according to the invention.

FIG. 4 represents a variant of an end leaf 3 according to FIG. 1, whereby the fixing strip 18 is in this case fixed to the end leaf 3 as it is formed of a folded part of this end leaf 3.

Such an embodiment of an end leaf 3 is advantageous in that its production is very simple, as the fixing strip 18 must not be glued to the end leaf 3.

The use of such an end leaf according to FIG. 4 is analogous to that of the embodiment of FIG. 1.

It is clear that in the embodiments of end leaf 3 which are represented in FIGS. 1 to 4, the dimensions of the fixing strip 18 can be freely chosen, and that they may be just as large as the dimensions of the leaves to be bound and the cover, or that they may be smaller.

It is also clear that the strip of glue 10 must not necessarily extend over only a part of the fixing strip 18, but that it may also be provided over the entire or practically the entire surface of the fixing strip 18.

In this case, the strip of glue 10 is realised with a self-adhesive glue, but it is not excluded according to the invention that this strip of glue 10 is realised by means of a glue which can be thermally activated, i.e. what is called a melting glue, or by means of a cold glue, which might be useful should the method be applied on an industrial scale.

Every time glue is mentioned further in this description, any type of glue is meant by it.

Since such a method according to the invention can merely use a simple, ordinary stapler instead of expensive and complex manufacturing machines, such a method is economical and is particularly fit for small-scale or private applications.

It is clear, however, that the method according to the invention is not restricted to small-scale applications and that it is particularly fit for large-scale, industrial applications, whereby use can be made of other binding techniques than stapling, should that be necessary.

It goes without saying that the end leaves 3 may have practically the same format as the bundle of leaves to be bound, in which case the cover 4 does not have to be provided with an inner coating 6 or what are called "mirror leaves" glued onto the insides of the leaves 8 and 9 of the cover 4.

It is not excluded, however, for the end leaves 3 to be made smaller than the bundle of leaves to be bound.

Figure 5:
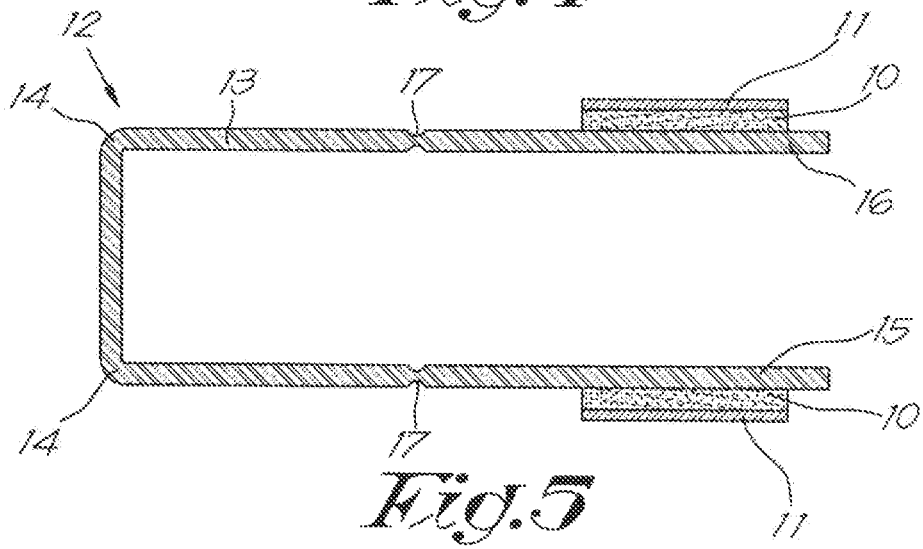
FIG. 5 represents a binding element which can be used to bind a bundle of loose leaves in a cover.

FIG. 5 represents a binding element 12 which in this case mainly consists of a folding element 13 which in this case, but not necessarily, is made of a layer of cardboard and which is also provided with folding lines 14.

The binding element 12 is also provided with two strips of material 15 and 16 which in this case are part of this binding element 12, but which can also be made in the shape of separate strips of material which are connected to the free ends of the folding binding element 12 in a folding manner at folding or perforation lines 17.

On each of the above-mentioned strips of material 15 and 16 is in this case provided a strip of glue 10 on the outside of the folding binding element 12 which extends entirely or partly over a respective strip of material 15 or 16 and which, if required, can be covered with a foil 11.

It is clear that the binding element 12 must not necessarily be pre-formed, but that one can also start with a flat element which is provided with one or several strips of glue 10 on one side and which is folded in the required U-shape before use, as is represented in FIG. 4.

It is also clear that the above-mentioned strips of material 15 and 16 may have any dimensions whatsoever and that they may be smaller than the leaves to be bound or almost equally large as this bundle of leaves.

Figure 6:
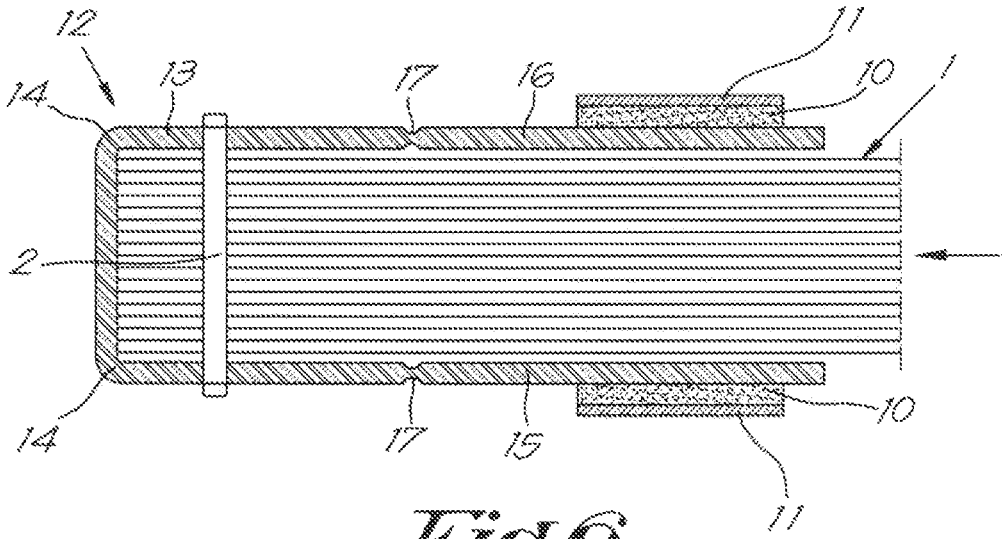
FIGS. 6 and 7 represent different steps that are successively followed when binding a bundle of loose leaves with a binding element according to FIG. 5.
Figure 7:
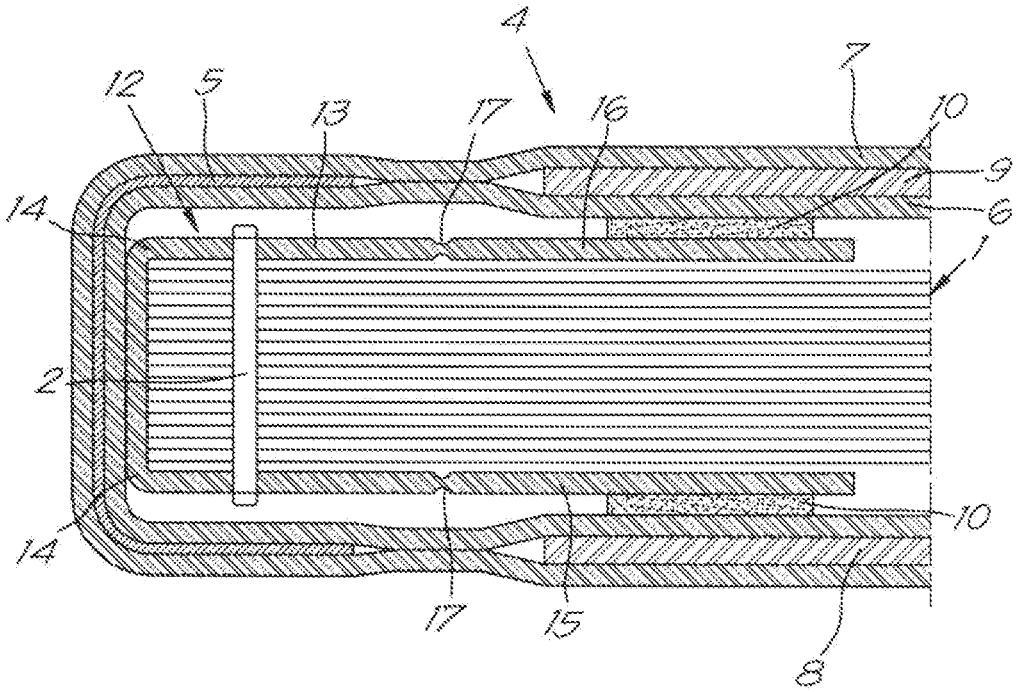

The method for binding a bundle of loose leaves 1 or the like by means of a binding element 12 according to FIG. 5 is very simple and is represented in FIGS. 6 and 7.

As is represented in FIG. 6, the above-mentioned binding element 12 folded in a U-shape is provided round a free edge of a bundle of loose leaves 1, and this free edge of the above-mentioned bundle of loose leaves 1 and the binding element 12 provided around it are joined together by means of one or several staples 2 in this case.

As is represented in FIG. 7, the bundle of leaves 1 is subsequently provided with its bound, stapled edge in the U-shaped back 5 of a cover 4 and this bundle of leaves 1 is fixed in this cover 4, to which end, in the given example, the above-mentioned strips of material 15 and 16, after the above-mentioned foils 11 have been removed, are glued with their strips of glue 10 onto the respective insides of the cover 4.

In the given example, the binding element 12 is made of cardboard, but it is clear that this binding element 12 can be made of many other materials, such as among others paper, which can preferably be stapled and which can preferably be folded as well so as to form a U-shaped element or which have already been made according to such a U-shape.

The example of binding element 12 represented in FIG. 4 is provided with two strips of material 15 and 16, but it is clear that the presence of such strips of material 15 and 16 is not required and that the above-mentioned bundle of leaves 1 can also be fixed in the cover 4, and particularly in the back 5 of this cover 4, by means of a strip of glue which is provided on the back of the U-shaped part of the binding element 12.

Nor is it excluded that merely one strip of material 15 or 16 is provided, onto which is provided a strip of glue 10, either or not combined with the presence of a strip of glue on the back of the binding element 12.

Figure 8:
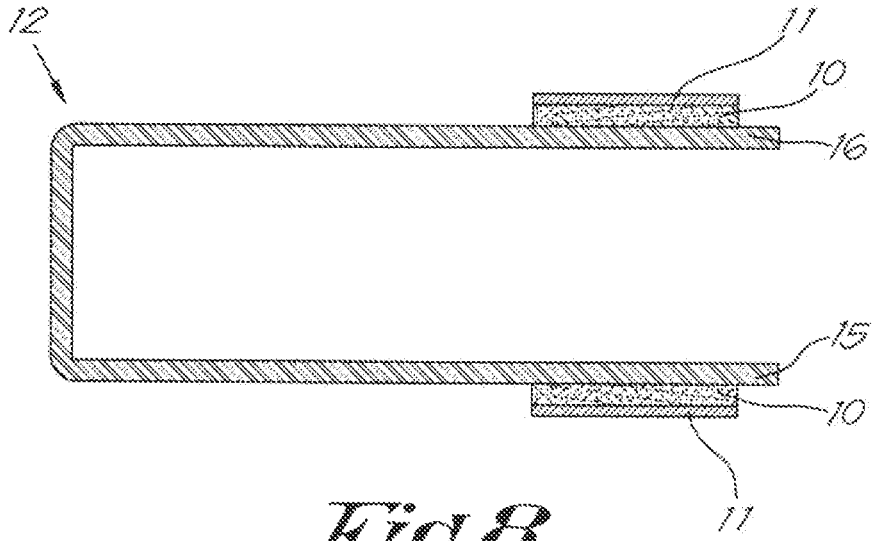
FIGS. 8 and 9 represent variants of a binding element according to FIG. 5.

FIG. 8 represents another embodiment of a binding element 12 according to FIG. 5 which is made in the shape of a pre-folded U-shaped mould made of a flexible material, whereby the strips of material 15 and 16 are integrally part of the binding element 12 and whereby, thanks to the flexibility of the selected material, no folding or perforation lines must be provided.

Figure 9:
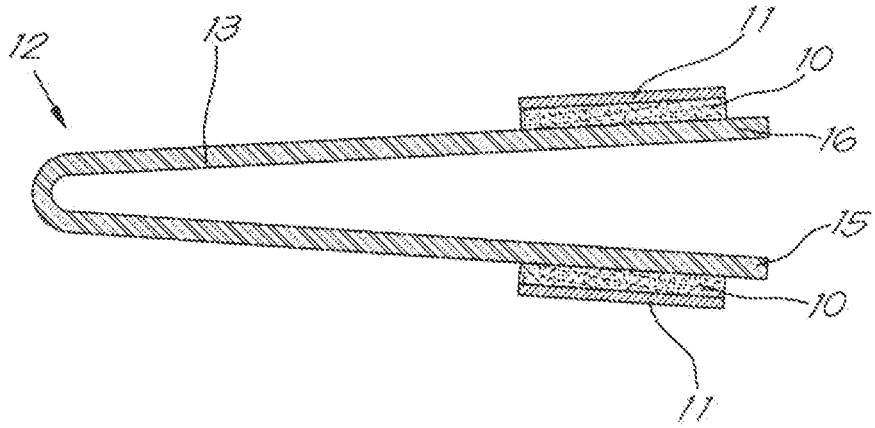

FIG. 9 represents yet another possible embodiment of a binding element 12 according to FIG. 5 which in this case is made V-shaped instead of U-shaped and which is more appropriate for the binding of thin bundles of leaves 1.

It is clear that, in all the embodiments of binding element 12 which are represented in FIGS. 5 to 9 the strip of glue 10 can only extend over a restricted width, or it can be realised in the shape of a surface of glue which extends over the entire or almost the entire surface of a respective strip of material 15 or 16.

Figure 10:
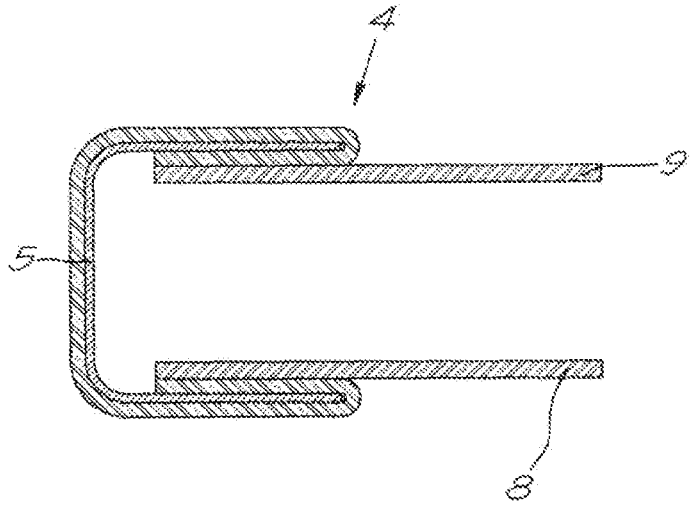
FIG. 10 represents a variant of a cover with a back used in a method according to the invention.

FIG. 10 shows a variant of a cover with a back used in a method according to the invention whereby leaves 8 and 9 of the cover 4 are in this case made in the shape of flexible strips of material, for example plastic, paper or the like, which are glued onto the respective inner sides of the legs of the U-shaped back 5.

Figure 11:
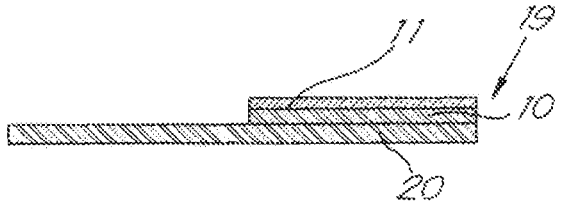
FIG. 11 represents a variant of a binding element according to FIG. 5.

FIG. 11 represents a variant of a binding element according to FIG. 5.

The above-mentioned binding element 19 is in this case made in the form of a strip of material 20 which is preferably made of a material that can be stapled.

The above-mentioned strip of material 20 is provided with a strip of glue 10 on at least one side which, is situated at a distance A from a side edge of the strip of material which is larger than the depth D of the U-shaped back 5 of the cover 4.

Naturally, the above-mentioned strip of material 20 can be made in any dimensions whatsoever and it may have the shape, for example, of a leave having the same dimensions as the bundle of leaves 1 to be bound.

Figure 12:
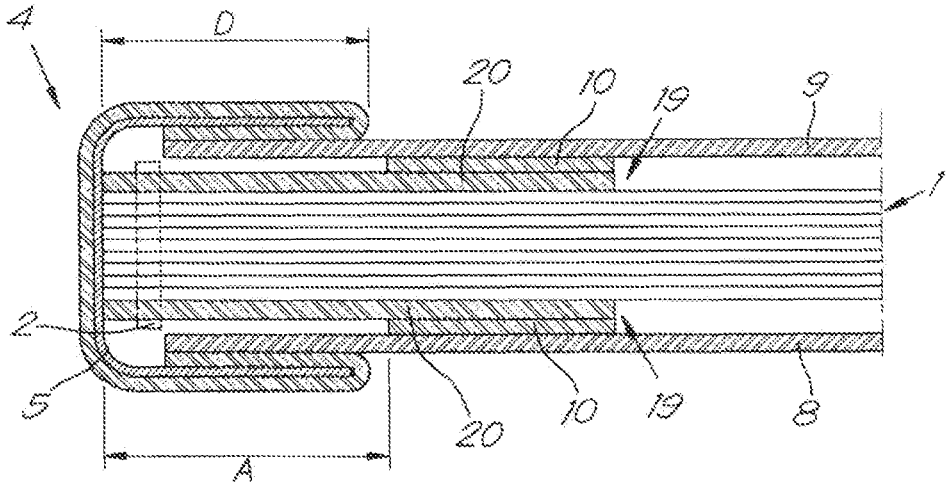
FIG. 12 represents a bundle of leaves bound in a cover using a binding element according to FIG. 11.

The use of the binding element 19 according to FIG. 11 is represented in FIG. 12, whereby two such binding elements 19 are provided on each side of the bundle of leaves 1 to be bound in this case and are bound with the latter, for example by means of staples 2, such that these binding elements 19 with their respective strips of glue 10 are turned outward, away from the bundle of leaves 1 to be bound.

Next, the bound bundle of leaves is provided in the cover 4, which is in this case provided with leaves 8 and 9 made of a flexible material, for example plastic, paper or the like, and the respective strips of glue 10 are glued onto a respective leave 8 or 9.

Figure 13:
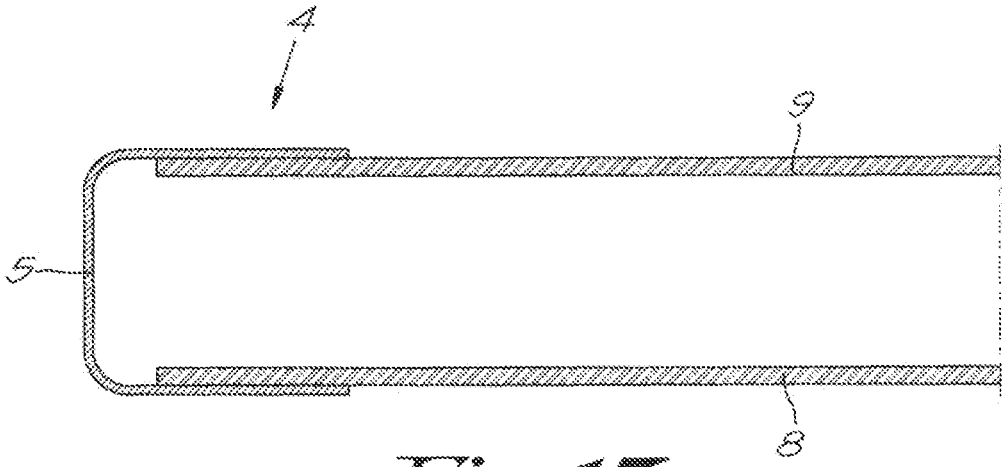
FIGS. 13 to 15 represent variants of a cover according to FIG. 10.

FIG. 13 represents a variant of a cover 4 according to FIG. 10, whereby the back 5 is not provided with a coating in this case, and whereby leaves 8 and 9 are glued onto the respective insides of the legs of the back.

The leaves 8 and 9 are preferably made of a flexible material such as paper or plastic.

A method for binding a bundle of loose leaves in such a cover 4 is identical to the method which is represented in FIGS. 2 and 3 respectively.

Figure 14:
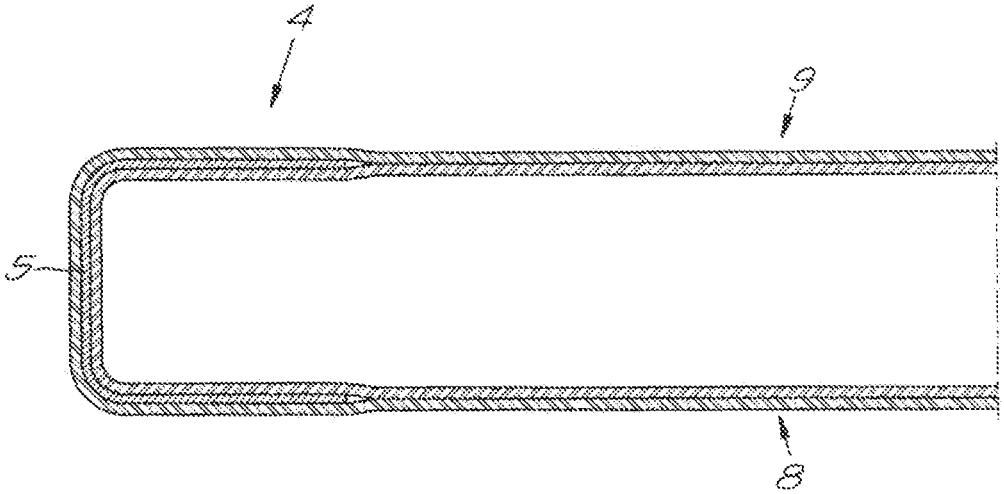

FIG. 14 represents another embodiment of a cover according to FIG. 10, whereby the leaves 8 and 9 are in this case formed of parts of the coating of the back 5 which extend past the far ends of the legs of the back 5, and which are glued onto each other.

Figure 15:
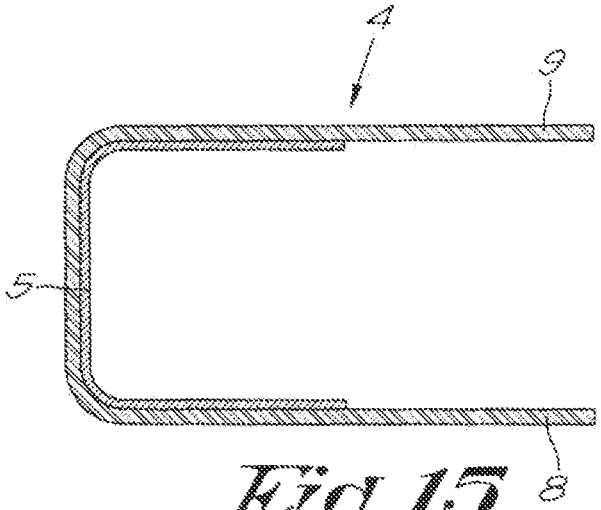

It is clear that the leaves may also be formed by using only the outside coating of the back 5, as is represented in FIG. 15, or only the inside coating of the back 5.

The dimensions of the leaves 8 and 9 may be freely selected according to the invention and must not necessarily be equal to the dimensions of the bundle of leaves to be bound, but they may also be formed, as represented in FIG. 15, of a thin strip of material.

The present invention is by no means limited to the method and end leaf 3 given as an example and represented in the figures; on the contrary, such a method according to the invention for binding a bundle of loose leaves 1 or the like, and an end leaf 3 applied thereby, can be made according to many variants while still remaining within the scope of the invention.

What is claimed is:

1. Method for binding a bundle of loose leaves or the like in a cover with a back and leaves joined to the back, comprising the following steps:

providing at least one end leaf that is provided with a fixing strip on a side edge of the at least one end leaf, said fixing strip being partly fixed to the at least one end leaf and being provided with a strip of glue on a part of the fixing strip which is not fixed to the at least one end leaf and on the side of the fixing strip turned away from the at least one end leaf, said strip of glue being provided with a removable foil, said strip of glue being provided at a distance from the above-mentioned side edge of the at least one end leaf wherein said distance (A) is being almost equal to or somewhat larger than the depth (D) of the back of the cover;

binding the bundle of loose leaves together with the at least one end leaf to form a bound edge of the bundle of leaves;

removing the foil; and providing the bundle of leaves with its bound edge in the back of the cover and fixing at least one side of said bundle with the at least one end leaf in the cover using only the strip of glue such that the fixing strip is fixed to one side of the leaves of the cover near the back of this cover.

2. Method according to claim 1, wherein the bundle of loose leaves is bound together with two end leaves, one on either side of the bundle.

3. Method according to claim 1, wherein the free edge of the bundle of loose leaves is bound together with the at least one end leaf by stapling.

4. Method according to claim 1, wherein the strip of glue on the fixing strip is a self-adhesive glue for binding the at least one side of the bundle of leaves which are bound together with the end leaf having only the strip of self-adhesive glue.

5. At least one end leaf for binding a bundle of loose leaves bound together with a side edge of the at least one end leaf in a cover wherein the at least one end leaf is provided with a fixing strip on its side edge to be bound in the cover, said fixing strip being partly fixed to the at least one end leaf and being provided with a strip of glue on a part of the fixing strip which is not fixed to the at least one end leaf and on the side of the fixing strip turned away from the at least one end leaf, said strip of glue being provided on the fixing strip at a distance from the above-mentioned side edge of the at least one end leaf to be bound wherein said distance (A) is being almost equal to or somewhat larger than the depth (D) of the back of the cover so that, when the bundle of leaves bound together with the at least one end leaf is bound in the cover, the fixing strip is fixed to one side of the leaves of the cover near the back of this cover, said strip of glue being provided with a removable foil that has to be removed for fixing the fixing strip of the at least one end leaf to the one side of the cover by said strip of glue only.

6. End leaf according to claim 5, wherein the strip of glue is a strip of self-adhesive glue.

7. End leaf according to claim 5, wherein the fixing strip is fixed to the end leaf by gluing.

8. End leaf according to claim 5, wherein the fixing strip is formed of a folded part of the end leaf.

9. End leaf according to claim 5, wherein the strip of glue is provided near and parallel to an edge that is free of the fixing strip of this end leaf.

10. End leaf according to claim 5, wherein the end leaf is made of a material which can be stapled.

11. End leaf according to claim 5, wherein the end leaf is made of paper or cardboard.

12. End leaf according to claim 5, wherein the fixing strip has smaller dimensions than the end leaf.

* * * * *